US007731838B2

(12) United States Patent
McConnachie et al.

(10) Patent No.: US 7,731,838 B2
(45) Date of Patent: Jun. 8, 2010

(54) SOLID ACID ASSISTED DEEP DESULFURIZATION OF DIESEL BOILING RANGE FEEDS

(75) Inventors: Jonathan M. McConnachie, Annandale, NJ (US); Catalina L. Coker, Baytown, TX (US); Madhav Acharya, Vienna, VA (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 210 days.

(21) Appl. No.: 11/900,449

(22) Filed: Sep. 11, 2007

(65) Prior Publication Data

US 2009/0065398 A1 Mar. 12, 2009

(51) Int. Cl.
*C10G 17/06* (2006.01)

(52) U.S. Cl. ..... 208/211; 208/90; 208/97; 208/98; 208/265; 208/266

(58) Field of Classification Search ..... 208/90, 208/97, 219–222, 266–267, 273
See application file for complete search history.

(56) References Cited

U.S. PATENT DOCUMENTS

| | | | | |
|---|---|---|---|---|
| 4,962,269 | A * | 10/1990 | LaPierre et al. | 585/739 |
| 5,503,818 | A * | 4/1996 | Nicolaides | 423/327.1 |
| 5,897,768 | A | 4/1999 | McVicker et al. | |
| 6,551,501 | B1 | 4/2003 | Whitehurst et al. | |
| 6,656,348 | B2 * | 12/2003 | Dassori et al. | 208/210 |
| 2002/0121459 | A1 * | 9/2002 | Pradhan et al. | 208/88 |
| 2004/0118749 | A1 | 6/2004 | Lesemann et al. | |
| 2005/0029162 | A1 | 2/2005 | Shih et al. | |
| 2005/0092654 | A1 * | 5/2005 | Ellis et al. | 208/89 |

OTHER PUBLICATIONS

Laredo, G.C. et al (2004). Applied Catalysis A, 265, 171-183.*
Gary, J. et al (1994). Petroleum Refining Technology and Economics, 3rd ed., Marcel-Dekker, 467 pgs.*
Zinenko, S.A. (2002). Chemistry and Technology of Fuels and Oils, 38(5), 303-308.*

* cited by examiner

*Primary Examiner*—Robert J Hill, Jr.
*Assistant Examiner*—Brian McCaig

(57) ABSTRACT

The instant invention relates to a process to produce low sulfur diesel products through the hydrodesulfurization of low nitrogen diesel boiling range feedstreams in the presence of solid acidic materials.

20 Claims, No Drawings

SOLID ACID ASSISTED DEEP DESULFURIZATION OF DIESEL BOILING RANGE FEEDS

FIELD OF THE INVENTION

The instant invention relates to a process for upgrading of hydrocarbon mixtures boiling within the diesel range. More particularly, the instant invention relates to a process to produce low sulfur diesel products through hydrodesulfurization of low nitrogen diesel boiling range feedstreams.

BACKGROUND OF THE INVENTION

Currently, there exists a need to reduce the sulfur and aromatics content of motor fuels, in particular diesel, to meet current environmental emission regulations. New "ultra-low-sulfur" diesel specifications are being implemented in the United States Europe and Japan. Under these new regulations, it is proposed that the sulfur level in diesel fuels be reduced to below 0.005 wt. % sulfur, while future regulations may go below this maximum sulfur level. Therefore, many methods have been proposed for producing low sulfur diesel fuels such as, for example, using high pressure reactors, feed undercutting, reducing run lengths, and utilizing high activity hydrodesulfurization catalysts.

However, each of these methods has certain drawbacks. For example, while both the sulfur and aromatics content of diesel boiling range feedstreams from which diesel motor fuels are derived can be reduced to a satisfactory level through the use of catalytic treatments, the catalytic treatments are severely impeded by nitrogen-containing compounds present in the feedstream. Further, conventional hydrodesulfurization catalysts are typically not efficient at removing sulfur from compounds where the sulfur atom is sterically hindered such as those sulfur atoms in multi-ring aromatic sulfur compounds.

U.S. Published Patent Application 2005/0029162 describes methods for desulfurization of naphtha feedstocks having a boiling range from 50° F. (10° C.) to 450° F. (232° C.). The methods include optionally contacting a naphtha feedstock with an acidic material to remove nitrogen compounds, contacting at least a portion of the resulting stream under hydroisomerization conditions with a zeolite having an alpha value between 1 and 100, and then performing a selective desulfurization on at least a portion of the hydroisomerized stream. The methods produce gasoline with improved octane, by a mechanism which appears to at least partially involve converting straight chain olefins into branched olefins. It is believed that this improves octane both because branched olefins are less likely to become saturated, and because any saturation of branched olefins that does occur still results in a branched paraffin, which has a higher octane value than the corresponding straight-chain paraffin.

U.S. Published Patent Application 2005/0023190 also describes methods for desulfurization of naphtha feedstocks having a boiling range from 50° F. (10° C.) to 450° F. (232° C.). The methods include optionally contacting a naphtha feedstock with an acidic material to remove nitrogen compounds, contacting at least a portion of the resulting stream under hydroisomerization conditions with a zeolite, and then performing a selective desulfurization on at least a portion of the hydroisomerized stream. The methods also produce gasoline with improved octane by a mechanism which appears to at least partially involve converting straight chain olefins into branched olefins.

U.S. Published Patent Application 2005/0023191 describes methods for desulfurization of naphtha feedstocks having a boiling range from 50° F. (10° C.) to 450° F. (232° C.). The methods include optionally contacting a naphtha feedstock with an acidic material to remove nitrogen compounds, and then contacting the feedstock with a supported catalyst including at least one medium pore zeolite, at least one Group VI metal, and at least one Group VIII metal. The methods produce gasoline with improved octane, by a mechanism which appears to at least partially involve converting straight chain olefins into branched olefins.

U.S. Pat. No. 6,063,265 provides a process for deep desulfurization of gas oils. The process requires the use of a catalyst that includes a Group VIB metal, a Group VIII metal, and phosphorous.

U.S. Pat. No. 5,897,768 provides a process for improving the desulfurization of petroleum feeds containing hindered dibenzothiophenes. The method includes treating a petroleum feed with a hydrodesulfurization catalyst under hydrodesulfurization conditions and with a solid acid catalyst under isomerization and/or transalkylation conditions.

What is needed is a process that provides further improvement in the speed and efficiency of removal of sulfur from diesel feedstocks.

SUMMARY OF THE INVENTION

In an embodiment, the invention is directed to a process for producing low sulfur diesel product streams that includes contacting a diesel boiling range feedstream containing organically bound sulfur molecules and nitrogen-containing compounds with a material in a contacting stage operated under conditions effective at removing at least a portion of said nitrogen-containing compounds in said diesel boiling range feedstream. This produces at least a contacting stage effluent comprising at least a diesel boiling range effluent containing organically bound sulfur molecules and having a reduced amount of nitrogen-containing compounds. At least a portion of said contacting stage effluent is then contacted in a first reaction stage and, in the presence of a hydrogen-containing treat gas, in a second reaction stage. The first reaction stage is operated under conditions effective at isomerizing at least a portion of said organically bound sulfur molecules with a first catalyst comprising at least one solid acidic component having an alpha value in the range of about 1 to about 50 thereby producing at least a first reaction stage effluent. The contacting in the second reaction stage is in the presence of a hydrogen-containing treat gas. The second reaction stage is operated under effective hydrotreating conditions with a second catalyst selected from hydrotreating catalysts comprising at least one Group VIII metal oxide and at least one Group VI metal oxide thereby producing at least a desulfurized diesel boiling range product stream.

In another embodiment of the invention, the first catalyst and the second catalyst are in a single reaction stage wherein said single reaction stage comprises at least one reactor or reaction zone.

In still another embodiment, the invention includes:

a) contacting a feedstream that includes 600° F.+ boiling compounds and has an end boiling point of about 800° F. or less, and that also contains organically bound sulfur molecules and nitrogen-containing compounds, with a material in a contacting stage operated under conditions effective at removing at least a portion of said nitrogen-containing compounds in said feedstream thereby producing at least a contacting stage effluent containing organically bound sulfur molecules and having a reduced amount of nitrogen-containing compounds;

b) contacting at least a portion of said contacting stage effluent in a first reaction stage operated under conditions effective at isomerizing at least a portion of said organically bound sulfur molecules with a first catalyst comprising at least one solid acidic component having an alpha value in the range of about 1 to about 50 thereby producing at least a first reaction stage effluent; and c) contacting, in the presence of hydrogen-containing treat gas, at least a portion of the first reaction stage effluent of step b) above in a second reaction stage operated under effective hydrotreating conditions with a second catalyst selected from hydrotreating catalysts comprising at least one Group VIII metal oxide and at least one Group VI metal oxide thereby producing at least a desulfurized diesel boiling range product stream.

DETAILED DESCRIPTION OF THE PREFERRED EMBODIMENTS

The invention provides for improved sulfur removal in diesel boiling range feedstreams by improving the speed and efficiency of removal of "hard" sulfur, such as sulfur contained in hindered alkyl-substituted dibenzothiophene compounds. This is accomplished by removing nitrogen compounds from the feedstream, which enhances the performance of subsequent isomerization and hydrodesulfurization processes. In particular, removal of nitrogen enhances the ability of the subsequent processes to remove "hard" sulfur, such as sulfur contained in compounds like hindered alkyl-substituted dibenzothiophenes. The invention provides a particular advantage for sulfur removal, as it has been unexpectedly found that removal of nitrogen aids both isomerization of hard sulfur species and removal of hard sulfur species.

The types of "hard" sulfur species in gasoline or naphtha feedstocks are quite different from the "hard" sulfur species in diesel feedstocks (and other feedstocks with a higher boiling range). Naphtha feedstocks typically have boiling points below 500° F. In such feedstocks, the more difficult to remove sulfur species are various types of thiophenes, including unhindered and hindered alkyl-substituted thiophenes. In a journal article published in Industrial Engineering and Chemical Research (Vol. 36, pp 1519-1523, 1997), Hatanaka, et al., demonstrated that in the hydrodesulfurization of catalytically cracked naphtha HDS, the HDS rate of thiophene and unhindered alkyl-substituted thiophenes does not differ significantly from the HDS rate of hindered alkyl-substituted thiophenes. All of these thiophenes are believed to be desulfurized by a mechanism involving direct C—S bond hydrogenolysis, so any isomerization that might occur in alkyl-substituted thiophenes does not change the desulfurization mechanism. Thus, acid isomerization of alkyl groups on substituted thiophenes has essentially no effect on the deep desulfurization of naphtha.

Diesel feedstocks, which typically include fractions in the 600° F.+ boiling range, contain additional types of sulfur species, including alkyl-substituted dibenzothiophenes. These alkyl-substituted dibenzothiophenes are not typically present in a naphtha fraction. The HDS rate of hindered alkyl-substituted dibenzothiophenes is significantly slower in gas oils than dibenzothiophene or unhindered alkyl-substituted dibenzothiophenes. This is due to a change in the HDS reaction pathway. Dibenzothiophenes and unhindered alkyl-substituted dibenzothiophenes are desulfurized via a direct C—S bond hydrogenolysis, similar to the situation for the thiophene sulfur removal mentioned above. By contrast, hindered dibenzothiophenes require a two-step pathway for sulfur removal that includes hydrogenation of an aromatic ring followed by the C—S bond hydrogenolysis. At low and moderate pressures, the hydrogenation step is the rate limiting step for hindered dibenzothiophene HDS.

In this invention, it has been found that the rate of deep desulfurization for gas oils, and other feedstocks containing 600° F.+ boiling range compounds, can be improved by isomerizing hindered alkyl-substituted dibenzothiophenes to form unhindered dibenzothiophenes. This facilitates the removal of sulfur as the sulfur can be removed by the faster pathway of direct C—S bond hydrogenolysis without having to first hydrogenate an aromatic ring. Thus, acid isomerization of alkyl substituents on dibenzothiophenes in gas oils allows for faster and more effective deep desulfurization of gas oils.

It should be noted that the terms "hydrotreating" and "hydrodesulfurization" are sometimes used interchangeably herein.

In an embodiment, the invention provides a process that produces low sulfur diesel boiling range products from diesel boiling range feedstreams containing organically bound sulfur molecules and nitrogen-containing compounds. The process involves removing at least a portion of the nitrogen containing compounds from the diesel boiling range feedstream by contacting the diesel boiling range feedstream with a material suitable for removal of nitrogen-containing compounds. The contacting of the diesel boiling range feedstream with the material occurs in a contacting stage, and the contacting produces a contacting stage effluent comprising at least a diesel boiling range effluent containing organically bound sulfur molecules and having a reduced amount of nitrogen-containing compounds. At least a portion of the contacting stage effluent is subsequently conducted to a first reaction stage wherein it is contacted with a first catalyst. The first catalyst includes at least one acidic material having an alpha value from about 1 to about 50, preferably less than about 30, and more preferably less than about 10. The contacting of at least a portion of the contacting stage effluent with the acidic material occurs under conditions effective at isomerizing at least a portion of the organically bound sulfur molecules and results in a first reaction stage effluent. At least a portion of the first reaction stage effluent is subsequently contacted in a second reaction stage, in the presence of hydrogen-containing treat gas, with a second catalyst selected from hydrotreating catalysts comprising at least one Group VIII metal oxide and at least one Group VI metal oxide. The second reaction stage is operated under effective hydrotreating conditions thereby producing at least a desulfurized diesel boiling range product stream.

Diesel boiling range feedstreams suitable for use in the present invention boil within the range of about 215° F. to about 800° F. Preferably, the diesel boiling range feedstream has an initial boiling point of at least 250° F., or at least 300° F., or at least 350° F., or at least 400° F., or at least 451° F. Preferably, the diesel boiling range feedstream has a final boiling point of 800° F. or less, or 775° F. or less, or 750° F. or less. In an embodiment, the diesel boiling range feedstream has a boiling range of from 451° F. to about 800° F. In another embodiment, the diesel boiling range feedstream also includes kerosene range compounds to provide a feedstream with a boiling range of from about 350° F. to about 800° F. These feedstreams can have a nitrogen content from about 50 to about 2000 wppm nitrogen, preferably about 50 to about 1500 wppm nitrogen, and more preferably about 75 to about 1000 wppm nitrogen. In another embodiment, the nitrogen content of the feedstream is at least 50 wppm, or at least 75 wppm, or at least 100 wppm. In still another embodiment, the nitrogen content of the feedstream is 2000 wppm or less, or 1500 wppm or less, or 1000 wppm or less. The nitrogen appears as both basic and non-basic nitrogen species. Non-limiting examples of basic nitrogen species may include quinolines and substituted quinolines, and non-limiting examples of non-basic nitrogen species may include carbazoles and substituted carbazoles. In an embodiment, feedstreams suitable for use herein have a sulfur content from about 100 to about 40,000 wppm sulfur, preferably about 200 to about 30,000 wppm, and more preferably about 350 to about 25,000 wppm. The sulfur appears as organically bound sulfur molecules, such as for example, sterically hindered organically bound sulfur molecules. Non-limiting examples of sterically hindered organically bound sulfur molecules include sterically hindered dibenzothiophenes, i.e., 4-methyldibenzothiophene or 4,6-diethyldibenzothiophene.

In the practice of the instant invention, the above-described diesel boiling range feedstreams are contacted in a contacting stage with a material suitable for the removal of nitrogen-containing compounds contained in the feedstream. Non-limiting examples of suitable materials include Amberlyst, alumina, silica, sulfuric acid, and any other material known to be effective for the removal of nitrogen compounds from a hydrocarbon stream. It is preferred that the material be sulfuric acid and more preferred that the sulfuric acid be spent sulfuric acid obtained from an alkylation process unit. The contacting stage can be comprised of one or more reactors or reaction zones each of which can comprise the same material. In some cases, the material can be present in the form of beds, and fixed beds are preferred.

The contacting stage is operated under conditions effective for removal of at least a portion of the nitrogen-containing compounds present in the diesel boiling range feedstream thus producing a contacting stage effluent comprising at least a diesel boiling range effluent containing organically bound sulfur molecules and having a reduced amount of nitrogen-containing compounds. By at least a portion, it is meant at least about 10 wt. % of the nitrogen-containing compounds present in the feedstream, or at least about 25 wt %, or at least about 50 wt %, or at least about 75 wt %, or at least about 90 wt %. Preferably, the at least a portion of the nitrogen-containing compounds removed from the feedstream corresponds to at least that amount of nitrogen-containing compounds that will result in a contacting stage effluent containing less than about 50 wppm total nitrogen, based on the contacting stage effluent. More preferably the contacting stage effluent contains less than 25 wppm total nitrogen, most preferably less than 10 wppm nitrogen, and in an ideally suitable case, less than 5 wppm total nitrogen. Thus, by "conditions effective for removal of at least a portion of the nitrogen-containing compounds", it is meant those conditions under which the contacting stage effluent will have the above described total nitrogen concentrations, i.e. 10 wt. % removal, or 25 wt % removal, etc.

As stated above, a preferred embodiment of the instant invention utilizes sulfuric acid as the material in the contacting stage. In this embodiment, a diesel boiling range feedstream, as defined above, is intimately contacted with a sulfuric acid solution. The sulfuric acid solution suitable for use herein contains at least about 75 wt. % sulfuric acid, based on the sulfuric acid solution, preferably greater than about 80 wt. %, more preferably about 75 wt. % to about 88 wt. %. The sulfuric acid solution may be obtained through any means known. However, as stated above, it is more preferred that the sulfuric acid solution be the spent acid from an alkylation process unit having a sulfuric acid concentration within the above-defined ranges. A typical alkylation process involves combining an olefinic hydrocarbon feedstream containing $C_4$ olefins with isobutane to produce a hydrocarbonaceous mixture. This hydrocarbonaceous mixture is subsequently contacted with sulfuric acid. The sulfuric acid used for contacting the hydrocarbonaceous mixture is typically reagent grade sulfuric acid having an acid concentration of at least about 95 wt. %. Preferably the sulfuric acid has a sulfuric acid concentration of greater than about 97 wt. %. The hydrocarbonaceous mixture is contacted with the sulfuric acid under conditions effective at producing at least an alkylate and sulfuric acid solution. The sulfuric acid solution so produced comprises at least about 75 wt. % sulfuric acid, based on the sulfuric acid solution, preferably greater than about 75 wt. %, more preferably about 75 wt. % to about 92 wt. %, about 0.5 to about 5 wt. % water, with the remaining balance being acid soluble hydrocarbons. It is more preferred that the effective conditions be selected such that the sulfuric acid solution so produced comprises between about 82 and 92 wt. % sulfuric acid, about 1 to about 4 vol. % water, with the remaining balance being acid soluble hydrocarbons. However, it is most preferred that the effective conditions be selected such that the sulfuric acid solution so produced comprises between about 85 and 92 wt. % sulfuric acid, about 1.5 to about 4 vol. % water, with the remaining balance being acid soluble hydrocarbons.

It should be noted that it is within the scope of the present invention to dilute the sulfuric acid obtained from the alkylation unit, or otherwise, with a suitable diluent, preferably water, in order to provide a sulfuric acid solution having the above-described concentration of sulfuric acid, i.e. at least about 75 wt. % sulfuric acid, based on the sulfuric acid solution, preferably greater than about 75 wt. %, more preferably about 75 wt. % to about 88 wt. %. In order to determine the sulfuric acid concentration once the diluent has been added to the sulfuric acid solution, the sulfuric acid content and water content are measured by standard analytical techniques. The equivalent acid strength can then be calculated with the following formula: equivalent wt. % sulfuric acid=wt. % sulfuric acid/(wt. % sulfuric acid+wt. % water). In this formula, the acid soluble hydrocarbon content of the spent alkylation acid is treated as an inert diluent with respect to the sulfuric acid and water content.

In practicing this embodiment of the instant invention, the diesel boiling range feedstream is contacted with the sulfuric acid solution at an acid volumetric treat rate of greater than about 0.5 vol. %, based on the diesel boiling range feedstream, preferably about 0.5 to about 20 vol. %, and more preferably 0.5 to about 5 vol. %. The contacting can be achieved by any suitable method including both dispersive and non-dispersive methods. Non-limiting examples of suitable dispersive methods include mixing valves, mixing tanks or vessels, and other similar devices. Non-limiting examples of non-dispersive methods include packed beds of inert particles and fiber film contactors such as those sold by Merichem Company and described in U.S. Pat. No. 3,758,404, which is hereby incorporated by reference, which involve contacting along a bundle of metallic fibers rather than a packed bed of inert particles. Preferred contacting methods are non-dispersive, and more preferred contacting methods are those that are classified as dispersive.

The contacting of the diesel boiling range feedstream with the sulfuric acid solution produces at least a diesel boiling range product that is sent to suitable aromatics and sulfur removal processes. Thus, the used sulfuric acid solution, which now contains the removed nitrogen species, is preferably separated from the diesel boiling range product. The used sulfuric acid solution and the diesel boiling range product can be separated by any means known to be effective at separating an acid from a hydrocarbon stream. Non-limiting examples of suitable separation methods include gravity settling, electric field induced settling, centrifugation, microwave induced settling and settling enhanced with coalescing surfaces. However, it is preferred that the diesel boiling range product and the used sulfuric acid solution be separated, or allowed to separate, into layers in a separation device such as a settling tank or drum, coalescer, electrostatic precipitator, or other similar device.

The contacting of the diesel boiling range feedstream with the sulfuric acid solution also occurs under effective conditions. By effective conditions in this embodiment, it is to be considered those conditions that allow the sulfuric acid treatment to achieve a reduction of nitrogen of greater than about 85 wt. %, preferably greater than about 85 wt. % more preferably greater than about 90 wt. %. Thus, it can likewise be said that the contacting stage effluent will have a nitrogen level about 80%, preferably at least about 85%, more preferably at least about 90% lower than that of the diesel boiling range feedstream. This will typically result in a contacting stage effluent having a nitrogen level of less than about 200 wppm, preferably less than about 100 wppm, more preferably less than about 50 wppm, and most preferably less than about 20 wppm. It should also be noted that if sulfuric acid is selected as the material, effective conditions are also to be considered those conditions that minimize yield losses during the sulfuric acid solution treatment to about to about 0.5 to about 6 wt. %, preferably about 0.5 to about 4 wt. %, more preferably about 0.5 to about 3 wt. %.

At least a portion of the contacting stage effluent, preferably substantially all, is conducted to a first reaction stage. In the first reaction stage, the at least a portion of the contacting stage effluent is contacted with a first catalyst comprising at least one solid acidic component having an alpha value in the range of about 1 to about 50, preferably less than about 30, and more preferably less than about 10. While a range of alpha values can be used to achieve the desired isomerization reactions, due to the temperatures involved during the isomerization step, solid acid catalysts with higher alpha values lead to increased cracking of molecules in the feedstream. Solid acid catalysts include crystalline or amorphous aluminosilicates, aluminophosphates, and silicoaluminophosphates, sulfated and tungstated zirconia, niobic acid, and supported or bulk heteropolyacids or derivatives thereof.

Preferred solid acidic components suitable for use as first catalysts comprise at least one zeolite or molecular sieve. Zeolites or molecular sieves are porous crystalline materials and those used herein have an alpha value in the range of about 1 to about 50. Alpha value, or alpha number, is a measure of zeolite acidic functionality and is more fully described together with details of its measurement in U.S. Pat. No. 4,016,218, J. Catalysis, 6, pages 278-287 (1966) and J. Catalysis, 61, pages 390-396 (1980), which are all incorporated herein by reference. Generally the alpha value reflects the relative activity with respect to a high activity silica-alumina cracking catalyst. To determine the alpha value as used herein, n-hexane conversion is determined at about 800° F. Conversion is varied by variation in space velocity such that a conversion level of 10 to 60 percent of n-hexane is obtained and converted to a rate constant per unit volume of zeolite and compared with that of the silica-alumina catalyst, which is normalized to a reference activity of 1000° F. Catalytic activity is expressed as a multiple of this standard, i.e. the silica-alumina standard. The silica-alumina reference catalyst contains about 10 wt. % $Al_2O_3$ and the remainder is $SiO_2$. Therefore, as the alpha value of a zeolite catalyst decreases, the tendency towards non-selective cracking also decreases.

The at least one solid acid used as the first catalyst may be combined with a suitable porous binder or matrix material. Non-limiting examples of such materials include active and inactive materials such as clays, silica, and/or metal oxides such as alumina. Non-limiting examples of naturally occurring clays that can be composited include clays from the montmorillonite and kaolin families including the subbentonites, and the kaolins commonly known as Dixie, McNamee, Georgia, and Florida clays. Others in which the main mineral constituent is halloysite, kaolinite, dickite, nacrite, or anauxite may also be used. The clays can be used in the raw state as originally mixed or subjected to calcination, acid treatment, or chemical modification prior to being combined with the at least one zeolite.

It is preferred that the porous matrix or binder material comprises at least one of silica, alumina, or a kaolin clay. It is more preferred that the binder material comprise alumina. In this embodiment the alumina is present in a ratio of less than about 15 parts zeolite to one part binder, preferably less than about 10, more preferably less than about 5, and most preferably about 2.

The first reaction stage can be comprised of one or more reactors or reaction zones each of which can comprise each of which can comprise one or more catalyst beds of the same or different solid acidic material. Although other types of catalyst beds can be used, fixed beds are preferred. Non-limiting examples of suitable bed types include fluidized beds, ebullating beds, slurry beds, and moving beds. Interstage cooling or heating between reactors or reaction zones, or between catalyst beds in the same reactor, can be employed. Conventional cooling may also be performed through cooling utilities such as cooling water or air, or through use of a hydrogen quench stream. In this manner, optimum reaction temperatures can be more easily maintained.

The first reaction stage is operated under conditions effective at isomerizing at least a portion of the sulfur-containing compounds present in the contacting stage effluent thus producing at least a first reaction stage effluent. It is preferred that the effective conditions in the first reaction stage be selected such that at least a portion of the alkyl groups present in sterically hindered sulfur-containing compounds are isomerized to form a less or unhindered sulfur containing compound. It is even more preferred that the effective conditions in the first reaction stage be selected such that at least a portion of the alkyl groups present in sterically hindered dibenzothiophenes ("DBT's") are isomerized to form a less or unhindered DBT. Isomerizing the alkyl groups of sterically hindered sulfur-containing molecules, such as DBT's, is important because these molecules typically do not undergo direct hydrogenolysis but are desulfurized by the indirect hydrogen route, and it is also known that desulfurization is limited to hydrogen pressure in the reactor. At higher pressures, hydrogenation of sterically hindered sulfur-containing compounds such as DBT's is facile, but at low to moderate pressures, it is difficult to desulfurize the sterically hindered sulfur-containing molecules without resorting to higher reactor temperatures, which shorten catalyst life. Thus, the present invention achieves better desulfurization of diesel boiling range feedstreams by isomerizing the alkyl groups of the sterically hindered sulfur-containing molecules, such as DBT's, to form less or unhindered sulfur-containing molecules which readily desulfurize at low to moderate hydrogen pressures through hydrogenolysis. By low to moderate hydrogen pressures, it is meant 50 to about 1000 psig, preferably about 75 to about 800 psig, more preferably about 100 to about 700 psig, and most preferably about 150 to about 600 psig. In another embodiment, low to moderate hydrogen pressures refer to pressures less than about 800 psig, or less than about 700 psig, or less than about 600 psig, or less than about 500 psig. In still another embodiment, low to moderate hydrogen pressures refer to pressures of at least 50 psig, or at least 100 psig, or at least 150 psig, or at least 200 psig.

At least a portion of the first reaction stage effluent, preferably substantially all, is conducted to a second reaction stage operated under effective hydrotreating conditions wherein it is contacted, in the presence of hydrogen-containing treat gas, with a second catalyst. The contacting of the at least a portion of the first reaction stage effluent with the second catalyst produces at least a desulfurized diesel boiling range product stream. Suitable second catalysts are hydrotreating catalysts that are comprised of at least one Group VIII metal oxide, preferably an oxide of a metal selected from Fe, Co and Ni, more preferably Co and/or Ni, and most preferably Co; and at least one Group VI metal oxide, preferably an oxide of a metal selected from Mo and W, more preferably Mo, on a high surface area support material, such as, for example, at least one of silica, alumina, or a kaolin clay. Other suitable second catalysts include zeolitic catalysts, as well as noble metal catalysts where the noble metal is selected from Pd and Pt. The Group VIII metal oxide of the second reaction zone catalysts is typically present in an amount ranging from about 0.01 to about 20 wt. %, preferably from about 0.1 to about 12%. The Group VI metal oxide will typically be present in an amount ranging from about 1 to about 50 wt. %, preferably from about 5 to about 30 wt. %, and more preferably from about 10 to about 25 wt. %. All metal oxide weight percents are on support. By "on support" we mean that the percents are based on the weight of the support. For example, if the support were to weigh 100 g. then 20 wt. % Group VIII metal oxide would mean that 20 g. of Group VIII metal oxide was on the support.

The second catalysts used in the second reaction stage of the present invention are preferably supported catalysts. Any suitable refractory catalyst support material, preferably inorganic oxide support materials may be used as supports for the catalyst of the present invention. Non-limiting examples of suitable support materials include: zeolites, alumina, silica, titania, calcium oxide, strontium oxide, barium oxide, carbons, zirconia, diatomaceous earth, lanthanide oxides including cerium oxide, lanthanum oxide, neodymium oxide, yttrium oxide, and praseodymium oxide; chromia, thorium oxide, urania, niobia, tantala, tin oxide, zinc oxide, and aluminum phosphate. Preferred are alumina, silica, and silica-alumina. More preferred is alumina. Magnesia can also be used for the second reaction zone catalysts. It is to be understood that the support material can also contain small amounts of contaminants, such as Fe, sulfates, silica, and various metal oxides that can be introduced during the preparation of the support material. These contaminants are present in the raw materials used to prepare the support and will preferably be present in amounts less than about 1 wt. %, based on the total weight of the support. It is more preferred that the support material be substantially free of such contaminants. It is an embodiment of the present invention that about 0 to 5 wt. %, preferably from about 0.5 to 4 wt. %, and more preferably from about 1 to 3 wt. %, of an additive be present in the support, which additive is selected from the group consisting of phosphorus and metals or metal oxides from Group IA (alkali metals) of the Periodic Table of the Elements.

As previously stated, the first reaction zone effluent is contacted with the above-defined second catalyst in a second reaction stage under effective hydrotreating conditions to produce at least a desulfurized diesel boiling range product stream. By effective hydrotreating conditions, it is meant those conditions chosen that will achieve a resulting desulfurized diesel boiling range product stream having less than 50 wppm sulfur, preferably less than 15 wppm sulfur, more preferably less than 10 wppm sulfur. These conditions typically include temperatures ranging from about 200° C. to about 450° C., preferably about 250° C. to about 425° C., more preferably about 300° C. to about 400° C. Typical weight hourly space velocities ("WHSV") range from about 0.1 to about 20 $hr^{-1}$, preferably from about 0.5 to about 5 $hr^{-1}$ and hydrogen gas treat rates range from 200 to 10000 scf/B, preferably 500 to 5000 scf/B. Any effective pressure can be utilized, and pressures typically range from about 4 to about 70 atmospheres, preferably 10 to 50 atmospheres.

The second reaction stage can be comprised of one or more fixed bed reactors or reaction zones each of which can comprise one or more catalyst beds of the same or different second catalyst. Although other types of catalyst beds can be used, fixed beds are preferred. Such other types of catalyst beds include fluidized beds, ebullating beds, slurry beds, and moving beds. Interstage cooling or heating between reactors, or between catalyst beds in the same reactor, can be employed since some olefin saturation can take place, and olefin saturation and the desulfurization reaction are generally exothermic. A portion of the heat generated during hydrotreating can be recovered. Where this heat recovery option is not available, conventional cooling may be performed through cooling utilities such as cooling water or air, or through use of a hydrogen quench stream. In this manner, optimum reaction temperatures can be more easily maintained.

In one embodiment of the present invention the first and second reaction stages are combined to form one reaction stage. In this embodiment, at least a portion of the contacting stage effluent is conducted to a single reaction stage wherein it contacts a catalyst system comprising the first and second catalysts described above. In this embodiment, the first catalyst comprises from about 1 to about 90 percent of the catalyst system, i.e. total catalyst loading, of the single reaction stage while the second catalyst makes up the remainder. The first catalyst and the second catalyst may be combined in a single catalyst particle. It is preferred that the first catalyst comprises from about 1 to about 50 percent of the total catalyst loading of the single reaction stage, more preferably about 5 to about 33, most preferably about 10 to about 25. In this embodiment, the single reaction stage can be comprised of one or more fixed bed reactors or reaction zones each of which can comprise one or more catalyst beds of the same or different catalyst. Although other types of catalyst beds can be used, fixed beds are preferred. Such other types of catalyst beds include fluidized beds, ebullating beds, slurry beds, and moving beds. Interstage cooling or heating between reactors, or between catalyst beds in the same reactor, can be employed since some olefin saturation can take place, and olefin saturation and the desulfurization reaction are generally exothermic. A portion of the heat generated during hydrotreating can be recovered. Where this heat recovery option is not available, conventional cooling may be performed through cooling utilities such as cooling water or air, or through use of a hydrogen quench stream. In this manner, optimum reaction temperatures can be more easily maintained. This embodiment of the present invention may be especially attractive to those with existing hydrotreating units because one can simply substitute the percentages of the first catalyst outlined above for the hydrotreating catalyst already employed.

The above description is directed to several embodiments of the present invention. Those skilled in the art will recognize that other embodiments that are equally effective could be devised for carrying out the spirit of this invention.

The following examples will illustrate the improved effectiveness of the invention, but are not meant to limit the invention in any fashion.

Example 1

This example demonstrates the HDS activity advantage for HDS of a lower nitrogen content feed at equal sulfur content. A severely hydrotreated virgin diesel feed having a boiling range of 117° C. to about 382° C., a 50% TBP of 306° C., an API gravity of 36.8, and containing less than 1 wppm sulfur and 1 wppm nitrogen was spiked with 4,6-diethyldibenzothiophene ("DEDBT") to increase the sulfur content of the virgin feed to approximately 500 wppm sulfur. The feed was also spiked with the nitrogen containing compound tetrahydroquinoline ("THQ") to make feeds with nitrogen concentrations of 11 and 95 wppm.

The feeds were hydrotreated with a commercial cobalt molybdenum on alumina catalyst marketed as KF-756 under conditions including temperatures of 325° C., pressures of 300 psig $H_2$, and hydrogen treat gas rates of 1000 scf/B. Before hydrotreating the KF-756 was sulfided in the gas phase with 10% $H_2S/H_2$ using conventional methods. As can be seen in Table 1, at an equivalent starting feed sulfur level, KF-756 displays greater HDS relative volumetric activity (RVA) on lower nitrogen feedstocks.

TABLE 1

| Catalyst | Feed N (wppm) as THQ | HDS RVA comparison with KF-756 on 95 wppm N Feed |
|---|---|---|
| KF-756 | 0 | 2.7 |
| | 11 | 1.9 |
| | 95 | 1.0 |

Example 2

This example demonstrates the advantage of the invention of adding an acid catalyst component to a HDS catalyst system when treating low nitrogen content feeds. As separate particles, KF-756 was loaded into the reactor mixed with a faujasite type solid acid, ECR-32 (U.S. Pat. No. 4,931,267), having a Si:Al ratio of 13:1 and a Pt loading of 0.9 wt. % Pt (the Pt was added by incipient wetness impregnation of an aqueous Pt salt solution followed by calcination as is conventional). The KF-756 made up 80 wt. % of the total catalyst loading and the ECR-32 material made up the remainder. The three feeds from Example 1 were processed over the catalyst system under similar conditions following a standard sulfidation. The results of this experiment are shown in the Table 2.

TABLE 2

| Catalyst | Feed N (wppm) as THQ | HDS RVA comparison with KF-756 on equal wppm Nitrogen Feed | HDS RVA comparison with KF-756 on 95 wppm Nitrogen Feed |
|---|---|---|---|
| 80:20 (w:w) KF-756 + 0.9 wt. % Pt on ECR-32 (13:1 Si:Al) | 0 | 4.0 | 10.8 |
| | 11 | 2.3 | 4.3 |
| | 95 | 1.5 | 1.5 |

As can be seen in Table 2, the benefit of the acid isomerization component increases as the nitrogen level of the feed decreases. The HDS RVA activity improvement at the same nitrogen feed level increases from 1.5 to 4. This activity increases is a multiplier of the benefit seen for low nitrogen feeds. Thus, the combined hydrotreating/acid catalyst system on the feed with 0 wppm nitrogen as THQ displays greater than 10× the activity of KF-756 alone on the feed with 95 wppm nitrogen as THQ. Significantly, an increase in activity by the combined hydrotreating/acid catalyst system is seen even at low (non-zero) nitrogen feed levels as demonstrated on the 11 wppm nitrogen as THQ feed. This demonstrates that complete removal of nitrogen from a feed is not necessary to reap the benefits of the present invention.

Example 3

This example illustrates the importance of an acid catalyst for the invention. Five catalyst systems were tested on the 11 wppm N as THQ feed used in Example 1 under similar conditions (three of the catalysts were also tested at a higher temperature, 350° C.) following a standard sulfidation. The first system was the same as used in Example 2, but KF-756 made up 89 wt. % of the catalyst load and the 0.9 wt. % Pt on ECR-32 (13:1 Si:Al) was the remaining 11 wt. %. The second catalyst was an 80:20 (w:w) mixture of KF-756 and 0.9 wt. % Pt on ECR-32 but the ECR-32 had a Si:Al ratio of 66:1. The third catalyst was an 80:20 (w:w) mixture of KF-756 and 0.1 wt. % Pt on ECR-32 (66:1 Si:Al). The fourth catalyst was an 80:20 mixture of KF-756 and 0.5 wt. % Pt on a commercial amorphous silica-alumina catalyst, EAB-11, manufactured by UOP. The final catalyst was 0.9 wt. % Pt on alumina (a non-acidic support). Pt was added to the supports via conventional methods as in Example 2. The results of the HDS activity testing are shown in Table 3.

TABLE 3

| Catalyst | HDS RVA comparison with KF-756 on 11 wppm N feed at 325° C. | HDS RVA comparison with KF-756 on 11 wppm N feed at 350° C. |
|---|---|---|
| 89:11 (w:w) KF-756 + 0.9 wt. % Pt on ECR-32 (13:1 Si:Al) | 1.6 | — |
| 80:20 (w:w) KF-756 + 0.9 wt. % Pt on ECR-32 (66:1 Si:Al) | 2.2 | — |
| 80:20 (w:w) KF-756 + 0.1 wt. % Pt on ECR-32 (66:1 Si:Al) | 2.1 | 2.1 |

TABLE 3-continued

| Catalyst | HDS RVA comparison with KF-756 on 11 wppm N feed at 325° C. | HDS RVA comparison with KF-756 on 11 wppm N feed at 350° C. |
|---|---|---|
| 80:20 (w:w) KF-756 + 0.5 wt. % Pt on EAB-11 | 1.5 | 1.5 |
| 80:20 (w:w) KF-756 + 0.9 wt. % Pt on Alumina | 1.0 | 1.0 |

As seen in Table 3 the combination of KF-756 and an acid catalyst is effective even when the quantity of acid sites is reduced, such as 1) by a physical reduction when the amount of acid catalyst particles mixed with the hydrotreating catalyst is lowered by approximately half, e.g., the 89:11 mixture of KF-756 and 0.9 wt. % Pt on ECR-32 (13:1 Si:Al); or 2) a chemical reduction, when less alumina is added to the acid catalyst, but the particles are kept constant, e.g., the 80:20 mixture of KF-756 and 0.9 wt. % Pt on ECR-32 (66:1 Si:Al). Reducing the platinum from 0.9 to 0.1 wt % on the acid catalyst had no effect on the HDS benefit, as the number of acid sites present on the catalyst is sufficient under both platinum amounts. The hydrotreating and acidic catalyst system is also effective when a lower strength acid catalyst, i.e., an amorphous silica-alumina is used, as in the 80:20 mixture of KF-756 and 0.5 wt. % Pt on EAB-11. However, when a relatively non-acidic support such as alumina is used in place of the acidic support, no activity enhancement is observed. Raising the temperature of the system does not result in an activity boost for the KF-756 and 0.9 wt. % Pt on alumina system, but the activity enhancement for the 80:20 mixture of KF-756 and 0.1 wt. % Pt on ECR-32 or 0.5 wt. % Pt on EAB-11 is maintained.

Example 4

This example illustrates that a noble metal such as platinum is not necessary for the activity advantage, and that the acidic and hydrotreating component may be combined in one particle. The catalyst system consisted of an 80:20 wt. % mixture of alumina and ECR-32 (66:1 Si:Al) which were ground, mixed, and extruded together. The MoO3 and CoO levels in the finished catalyst were approximately 20% and 5%, respectively. The MoO3 was added as ammonium heptamolybdate in two impregnations to incipient wetness, with approximately two-thirds the molybdenum added in the first impregnation and one-third the molybdenum added in the second impregnation. After each impregnation the catalyst was left in a hood overnight, then dried at 120° C. for 2 hours, followed by calcination at 400° C. for 2 hours. The CoO was added as cobalt nitrate in a third impregnation to incipient wetness. The cobalt impregnated catalyst was left in a hood overnight, then dried at 120° C. for 2 hours, followed by calcination at 500° C. for 2 hours. The catalyst was tested after a conventional sulfiding using the general conditions in Example 1 at temperatures of 325° C. and 350° C. with 0 or 11 ppm N as THQ in the feed. The results of the HDS activity testing are shown in Table 4.

TABLE 4

| Catalyst | Feed N (wppm) as THQ | Temperature (° C.) | HDS RVA comparison with KF-756 |
|---|---|---|---|
| 80:20 (w:w) Al2O3: ECR-32 (66:1 Si:Al) with 20 wt. % MoO3 and 5 wt. % CoO | 0 | 325 | 2.1 |
| | 11 | 325 | 1.0 |
| | 11 | 350 | 1.6 |

As seen in Table 4 the cobalt molybdenum catalyst made from the coextruded Al2O3 and ECR-32 system displays over twice the activity of KF-756. Although the catalysts are not exactly equivalent, the 2.1× activity advantage is far greater than possible for simple impregnation of CoMo on alumina vs. a state of the art catalyst such as KF-756. The acid component is responsible for the increased HDS activity. The addition of 11 ppm N as THQ removed the activity contribution of the acid component at 325° C., but a substantial HDS activity advantage was regained upon increasing the reaction temperature to 350° C. This temperature dependence is probably due to the greater metal loading on the acid component of the support vs. the prior examples with platinum. The greater metal loading covered a substantial number of the acid sites of the catalyst, and the few remaining sites were poisoned by the nitrogen added to the feed. As expected the higher temperature altered the equilibrium of nitrogen adsorption on the catalyst and the activity benefit of the active component was regained. In comparison, as seen in Example 3, the HDS activity of the 80:20 (w:w) KF-756 and 0.9 wt. % Pt on alumina system did not respond after raising the reaction temperature to 350° C., because the alumina catalyst system lacks sufficiently strong acid sites. It could be expected that further optimization of the co-extruded ECR-32/alumina would lead to an activity boost at the lower temperature in the presence of nitrogen. The important feature of this invention is that a noble metal such as platinum is not necessary to obtain an activity benefit from the acid catalyst component. Furthermore, the example illustrates that the standard hydrotreating support and the acidic support component may be intimately mixed together in the same particle rather than physically mixed and still obtain a catalyst according to the invention.

Example 5

This example demonstrates the effectiveness of the invention on a nitrogen-removed acid-extracted real feed. A previously hydrotreated diesel oil having a boiling range of 127° C. to about 389° C., a 50% TBP of 308° C., an API gravity of 36.5, 484 wppm sulfur, and 85 wppm nitrogen was extracted with 1.5 wt % concentrated sulfuric acid, washed with dilute aqueous sodium hydroxide to neutralize any remaining acid, washed with water, and dried over magnesium sulfate to yield a product with 2 wppm nitrogen. Approximately one-half the sulfur in the diesel oil is hindered dibenzothiophenes. A fraction of the acid-extracted oil was spiked with approximately 500 wppm sulfur as 4,6-diethyldibenothiophene ("DEDBT") to increase the amount of hindered sulfur molecules in the feed.

KF-756 and a 88:12 w/w mixture of KF-756 and 0.9 wt % platinum on ECR-32 were liquid phase sulfided with a feed similar to the one used in Example 1 spiked with 6.5 wt % DMDS. The catalysts were tested with both the acid-extracted diesel oil and the acid-extracted diesel oil spiked with DEDBT at conditions similar to those used in Example 1. Results are shown in Table 5.

TABLE 5

| Catalyst | HDS RVA comparison with KF-756 on acid-extracted diesel oil | HDS RVA comparison with KF-756 on acid-extracted diesel oil spiked with DEDBT |
|---|---|---|
| 88:12 (w:w) KF-756 + 0.9 wt. % Pt on ECR-32 | 1.3 | 1.4 |

The catalyst system with ECR-32 acidic component exhibits a 30% activity credit on the acid-extracted diesel oil over KF-756 alone. Spiking the acid-extracted diesel oil with additional hindered dibenzothiophenes increases the activity credit relative to KF-756. The invention effectiveness increases as the fraction of hindered dibenzothiophenes in a feed increases.

What is claimed is:

1. A process for producing low sulfur diesel boiling range product comprising:

(a) contacting a diesel boiling range feedstream having a boiling range of from about 451° F. to about 800° F., the feedstream containing organically bound sulfur molecules and nitrogen-containing compounds, with a material in a contacting stage operated under conditions effective at removing at least a portion of said nitrogen-containing compounds in said diesel boiling range feedstream thereby producing at least a contacting stage effluent comprising at least a diesel boiling range effluent containing organically bound sulfur molecules and having a reduced amount of nitrogen-containing compounds; and (b) contacting at least a portion of said contacting stage effluent (i) in a first reaction stage operated under conditions effective at isomerizing at least a portion of said organically bound sulfur molecules with a first catalyst comprising at least one solid acidic component having an alpha value in the range of about 1 to about 50 thereby producing at least a first reaction stage effluent; and (ii) in the presence of hydrogen-containing treat gas, in a second reaction stage operated under effective hydrotreating conditions with a second catalyst selected from hydrotreating catalysts comprising at least one Group VIII metal oxide and at least one Group VI metal oxide thereby producing at least a desulfurized diesel boiling range product stream.

2. The process according to claim 1 wherein the diesel boiling range feedstream contains about 50-2000 wppm nitrogen.

3. The process according to claim 2 wherein the nitrogen present in said diesel boiling range feedstream includes carbazole and/or substituted carbazoles.

4. The process according to claim 3 wherein the feedstream includes sulfur in the form of sterically hindered organically bound sulfur molecules.

5. The process according to claim 4 wherein said sterically hindered organically hound sulfur molecules are dibenzothiophenes.

6. The process according to claim 1 wherein said first and second reaction stages comprise one or more catalyst beds selected from the group consisting of fluidized beds, ebullating beds, slurry beds, fixed beds, and moving beds wherein each of said one or more catalyst beds contains a catalyst suitable for the reaction zone in which the catalyst bed is located.

7. The process according to claim 1 wherein said material is selected from Amberlyst, alumina, silica, sulfuric acid, spent sulfuric acid obtained from an alkylation process unit, and any other material known to be effective at removing nitrogen compounds from a hydrocarbon stream.

8. The process according to claim 7 wherein said material is selected from sulfuric acid and spent sulfuric acid obtained from an alkylation process unit.

9. The process according to claim 8 wherein said material contains greater than about 75 wt. % sulfuric acid.

10. The process according to claim 1 wherein said solid acidic component of said first catalyst is selected from crystalline or amorphous aluminosilicates, aluminophosphates, and silicoaluminophosphates, sulfated and tungstated zirconia, niobic acid, and supported or bulk heteropolyacids or derivatives thereof.

11. The process according to claim 10 wherein said first catalyst is a zeolite or molecular sieve.

12. The process according to claim 10 wherein said first catalyst is an amorphous aluminosilicate.

13. The process according to claim 1 wherein said second catalyst is selected from hydrotreating catalysts comprising about 0.01 to about 20% of a Group VIII metal oxide and about 1 to about 50 wt. % of a Group VI metal oxide.

14. The process according to claim 1 wherein said first catalyst further comprises a suitable porous binder or matrix material selected from clays, silica, and/or metal oxides such as alumina.

15. The process according to claim 14 wherein said suitable porous binder or matrix material is alumina present in a ratio of less than about 15 parts zeolite to one part hinder.

16. The process according to claim 1 wherein the first catalyst and second catalyst are combined in the same catalyst particle.

17. The process according to claim 1 wherein the first reaction stage and the second reaction stage are combined to form one reaction stage.

18. A process for producing low sulfur diesel products comprising:

(a) contacting a feedstream that includes 600° F.+ boiling compounds, has an initial boiling point of at least about 400° F., and has an end boiling point of about 800° F. or less, and that also contains organically bound sulfur molecules in the form of sterically hindered dibenzothiophenes and nitrogen-containing compounds, with a material in a contacting stage operated under conditions effective at removing at least a portion of said nitrogen-containing compounds in said feedstream thereby producing at least a contacting stage effluent containing organically bound sulfur molecules and having a reduced amount of nitrogen-containing compounds;

(b) contacting at least a portion of said contacting stage effluent in a first reaction stage operated under conditions effective at isomerizing at least a portion of said organically bound sulfur molecules with a first catalyst comprising at least one solid acidic component having an alpha value in the range of about 1 to about 50 thereby producing at least a first reaction stage effluent; and (c) contacting, in the presence of hydrogen-containing treat gas, at least a portion of the first reaction stage effluent of step b) above in a second reaction stage operated under effective hydrotreating conditions with a second catalyst selected from hydrotreating catalysts comprising at least one Group VIII metal oxide and at least one Group VI metal oxide thereby producing at least a desulfurized diesel boiling range product stream.

19. The process of claim 18, wherein the first catalyst has an alpha value less than about 30.

20. The process of claim 18, wherein the first catalyst has an alpha value less than about 10.

* * * * *